US006289604B1

(12) United States Patent
Chang

(10) Patent No.: US 6,289,604 B1
(45) Date of Patent: Sep. 18, 2001

(54) ENVIRONMENTAL PROTECTION COMPLIANT, HIGHER PRODUCTIVITY FOOTWEAR VACUUM DRYER AND CONVEYANCE APPARATUS

(76) Inventor: Liang-Tsuen Chang, No. 23, Chin Kao Road, Pu Hsin Hsiang, Chang Hua County (TW)

( * ) Notice: Subject to any disclaimer, the term of this patent is extended or adjusted under 35 U.S.C. 154(b) by 0 days.

(21) Appl. No.: 09/385,684

(22) Filed: Aug. 30, 1999

(51) Int. Cl.[7] ..... F26B 25/00

(52) U.S. Cl. ..... 34/106; 34/62; 34/92; 34/105; 34/218; 34/236; 34/239

(58) Field of Search ..... 34/62, 92, 104, 34/105, 106, 107, 187, 201, 218, 236, 239

(56) References Cited

U.S. PATENT DOCUMENTS 3,681,850 * 8/1972 Freedman ..... 34/247
4,550,462 * 11/1985 Phillips ..... 12/17 R
4,887,368 * 12/1989 Latzke ..... 607/11
5,562,795 * 10/1996 Landrum et al. ..... 156/443

* cited by examiner

*Primary Examiner*—Pamela Wilson
(74) *Attorney, Agent, or Firm*—Dougherty & Troxell

(57) ABSTRACT

An environmental protection compliant, higher productivity footwear vacuum dryer and conveyance apparatus having a conveyor belt on which is disposed a plurality of footwear placement rod support and footwear placement tray units that convey the footwear sole and upper covering. The conveyor belt moves past one or more heating boxes and vacuum activation boxes and is accessible at intervals between the adjoining heating box and vacuum activation box. Inside the vacuum activation boxes, moisture content is evacuated and footwear of different materials are warmed by radiated heat, preventing damage to the footwear, while also activating the adhesive applied on the footwear to facilitate adhesion between the sole and upper covering of the footwear. The adhesive fumes generated by heating process are drawn into air intake ports along the two sides of the conveyor belt and pass through a pipeline into the intake ports of an air baffling and convergence flow distribution system to recycle the adhesive fumes accumulated in the heating device to minimize adhesive vapor emanations.

3 Claims, 11 Drawing Sheets

A-A

ENVIRONMENTAL PROTECTION COMPLIANT, HIGHER PRODUCTIVITY FOOTWEAR VACUUM DRYER AND CONVEYANCE APPARATUS

BACKGROUND OF THE INVENTION

1) Field of the Invention

The invention herein relates to an environmental protection compliant, higher productivity footwear vacuum dryer and conveyance apparatus comprised of a conveyor belt situated in between the two sides of a work platform and on which is disposed a number of footwear placement rod support and footwear placement tray units that convey footwear soles and upper coverings. The conveyor belt moves past one or more heating boxes and vacuum activation boxes and is accessible at the intervals between adjoining heating box and vacuum activation boxes the exact number of which is determined by the type of footwear and the type of adhesive utilized to bind the footwear. The hot air current circulatory channels inside the heating boxes increases heating efficiency and reduces electric power consumption. Inside the vacuum activation boxes, moisture content is evacuated and footwear of different material are warmed by radiated heat, thereby preventing damage to the footwear, while also activating the adhesive applied on the footwear to facilitate adhesion between the soles and upper coverings of the footwear. The adhesive fumes generated by the heating process are drawn into air intake ports along the two sides of the conveyor belt and pass through a conjoined pipeline from the heating device into the intake ports of an air baffling and convergence flow distribution system to recycle the adhesive fumes accumulated in the heating device to minimize adhesive vapor emanations. At the same time, the adhesive fumes inside the heating device and the vacuum drying device are discharged through an exhaust hood installed at the upper end, where the adhesive fumes are filtered out through an activated carbon isolation layer, which not only increases production efficiency, but also minimizes environmental pollution, simplifies the production process, reduces manpower requirements, lowers production costs, and effectively achieves environmental protection capability in an economical and practical way.

2) Description of the Prior Art

Conventional footwear production machines are available in an enormous range of types based on the particular utilization and footwear variety. Taking athletic footwear as an example, the final stage of construction requires the adhesion of the prefabricated shoe sole to the upper covering. Prior to the conjoimnent, an adhesive must be applied to the sole and the prefabricated upper covering at the area of adhesion and then be subjected to a drying process utilizing a footwear drying machine to cure the adhesive. If the adhesive lacks adhesiveness after drying, the drying period must be controlled to obtain an effective degree of adhesivness. While controlling the degree of adhesiveness, excessive or insufficient drying readily occurs that results in adhesion flaws, with the constant inspection of temperature by the operating personnel being very inconvenient. Furthermore, the footwear sole and upper covering may be made of different materials which would require the utilization of different types of adhesives as well as varying drying temperatures and periods. On the production line, the footwear upper coverings and soles are situated on the same assembly line and are conveyed past a footwear drying machine operating at the same temperature. If the sole is fabricated of a differing material, most footwear upper coverings can withstand a higher temperature than footwear soles due to the variance in construction material. Furthermore, there are different types of adhesives available at different costs and production line requirements that can be generally classified into three main types: oil-based, water-based, and hot-melt adhesives. Of these, the lowest cost type is the oil-based adhesive. However, this type requires the longest drying process and involves a greater utilization of drying machines, while the production line configuration must be quite lengthy, occupying considerable space since there must also be adequate access to the conveyor belt moving the footwear soles and upper coverings between each footwear drying machine. Since it is not possible to downscale the process and, furthermore, manpower requirements are proportionately increased, high footwear production costs and greater operating space prerequisites are unavoidable. It is of course possible to lower production costs and downscale the production process by utilizing water-based and hot-melt adhesives in that a lesser number of dry machines are required. While a minimum of two more drying machines has to be employed to output finished products, but the said space and costs still cannot be reduced considerably. Furthermore, a vacuum sulfurizing machine is required for shaping after adhesion, with the procedure necessarily involving the conveyance of the adhered footwear to another mechanical processing section which raises the defect rate and, furthermore, requires a larger number of machines, thereby increasing production costs, and reducing competitiveness. Additionally, the unpleasant fumes produced after the adhesive is heated pollutes the air and adversely affects worker health.

SUMMARY OF THE INVENTION

The primary objective of the invention herein is to provide an environmental protection compliant, higher productivity footwear vacuum dryer and conveyance apparatus comprised of a conveyor belt situated in between the two sides of a work platform and on which is disposed a number of footwear placement rod support and footwear placement tray units that convey footwear soles and upper coverings, with the conveyor belt moving past one or more heating boxes and vacuum activation boxes and accessible at the intervals between the adjoining heating boxes and vacuum activation boxes, the exact number of which is determined by the type of footwear and the type of adhesive utilized to bind the footwear, thereby enabling interchangeable assembly options to suit the required production process.

Another objective of the invention herein is to provide an environmental protection compliant, higher productivity footwear vacuum dryer and conveyance apparatus having a heater box with two heated air current circulation channels inside and a number of squirrel-cage fans at the upper end that circulate the heated air currents in the heater box into an auxiliary flow guide channel at the front and rear end, through an upper flow guide trap layer, and then drawn pass a heating element by the squirrel-cage fans furthermore, a number of squirrel-cage fans are mounted at the side of the heater box such that the heated air in the heating box are drawn through the air induction holes in the left side of the heating element, allowing the heated air to the left and the right accumulate behind the heating element and then proceed downward into the heating box which enables the heated air to maintain the adhesive at a constant temperature and increase adhesive drying temperature consistency and heating efficiency and, furthermore, the circulatory heating accomplished by the circulatory flow channels economizes electric power consumption.

Another objective of the invention herein is to provide an environmental protection compliant, higher productivity footwear vacuum dryer and conveyance apparatus wherein after the adhesive applied on the footwear is dried by the heating box, the soles and upper covers are carried by the conveyor belt into a vacuum dryer device, of which the said vacuum activation box consists of a top sealed hood having a partitioning wall that is vertically disposed in the center and there is a heater mounted on the upper end of both sides of the partitioning wall, with each heater capable of independent temperature control to the enable a different temperature setting at the soles and upper coverings on the footwear placement rod supports and footwear placement trays, and in the bottom sealed hood is a conjoined pipe connected to a vacuum pump that disperses outward from an exhaust box at the upper end of the heating box, thereby protecting the footwear, while evacuating the adhesive fumes.

Another objective of the invention herein is to provide an environmental protection compliant, higher productivity footwear vacuum dryer and conveyance apparatus wherein there are air intake holes along the work platform and, furthermore, mounted at the lower extent of the air intake holes is an air collector duct and the said air collector duct is connected to an air carrier pipe, the adhesive fumes are drawn via a squirrel-cage fan into an air baffling and convergence flow distribution system and then through the air discharge port towards the inside of the already operating heating box, and while the heat of the adhesive fumes are recycled in the heating box, air baffling is generated to disperse the adhesive fumes and minimize adhesive vapor emanations.

Another objective of the invention herein is to provide an environmental protection compliant, higher productivity footwear vacuum dryer and conveyance apparatus wherein there is an exhaust hood installed on the upper extent of the respective outer enclosures of the heating box and vacuum activation box, and an exhaust fan is mounted in each of the said exhaust hoods and situated at the lower extent of the fans are the removable-type activated carbon isolation layers such that the adhesive functions in the heating box and vacuum activation box are filtered out as they pass through the activated carbon isolation layers and the nonpermeated air is discharged away from the production site and, furthermore, can be additionally treated to effectively achieve environmental protection objectives and provides for a convenient and practical means of industrial exhaust purification.

Another objective of the invention herein is to provide an environmental protection compliant, higher productivity footwear vacuum dryer and conveyance apparatus wherein there is a suspending rod affixed at each of the four corners at the upper extent of the top sealed hood of the said vacuum activation box, with a bolt mounting the suspending rods to the top sealed hood, with the bolts ensleeved in a coil spring which is compressed by the suspending rod, and serves to keep the top sealed hood properly positioned under balanced tension against conveyance frame on the conveyor belt; and the upper ends of the said four suspending rods are mounted to the four corners of a suspending frame having an upper left and right horizontal drive rod extending from the center section of its two sides and, furthermore, mounted on the respective two ends of the upper left and right horizontal drive rods are upper left and right roller wheel assemblies that are disposed against left and right roller rails which limits them to upward and downward movement and thereby enables the top sealed hood to be moved upward and downward; extending from the two sides of the bottom sealed hood are lower left and right horizontal drive rods and, furthermore, mounted on the respective two ends of the lower left and right horizontal drive rods are lower left and right roller wheel assemblies that are similarly disposed against the left and right roller rails which limits them to upward and downward movement and thereby enables the bottom sealed hood to be moved upward and downward; push rods of left and the right gas pressure cylinders, respectively, are linked to the upper left and right horizontal drive rods, with the bodies of the left and the right gas pressure cylinders, respectively, linked to the lower left and right horizontal drive rods; furthermore, mounted in an appropriate area at the lower extent of the mounts of the upper left and right roller wheel assemblies as well as the lower extent of the lower left and right horizontal drive rods are upper and lower stop blocks; when the push rods of the left and the right gas pressure cylinders causes the downward movement of the top sealed hood, the mounts of the upper left and right roller wheel assemblies are held stationary against the upper stop block and the top sealed hood is enclosed over the footwear placement rod supports and footwear placement trays on the conveyance frame; since the push rod of the left gas pressure cylinders is immobilized by the upper stop block, the resulting upward pull of the body of the left gas pressure cylinder causes the bottom sealed hood to be driven against the lower extent of the conveyance frame, thereby achieving effecting sealing and enabling vacuum functions.

To enable the examination committee to further understand the technological content, operations, and other objectives of the invention herein, the brief description of the drawings below is followed by the detailed description of the preferred embodiments.

BRIEF DESCRIPTION OF THE DRAWINGS

FIG. 8AA is a cross-sectional drawing of the roller wheel and roller rail assemblies that drive the vacuum activation chamber of the invention herein.

FIG. 8CC is a cross-sectional drawing in magnified view of the suspending rod balanced tension structure of the top sealed hood of the vacuum activation chamber of the invention herein.

DETAILED DESCRIPTION OF THE PREFERRED EMBODIMENTS

Figure 1:
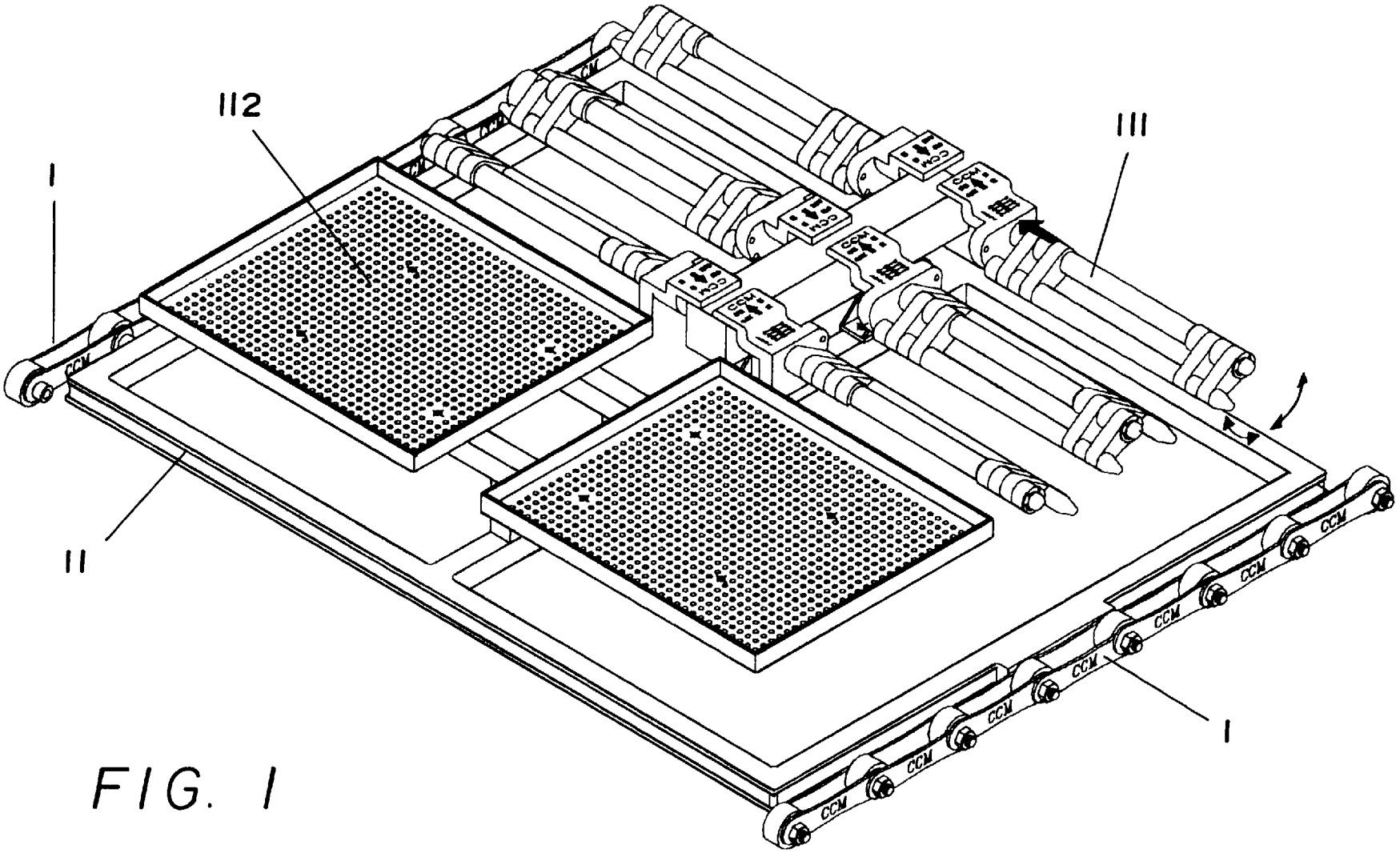
FIG. 1 is an isometric drawing of the footwear placement rod support units and the footwear placement tray units of the invention herein.
Figure 6:
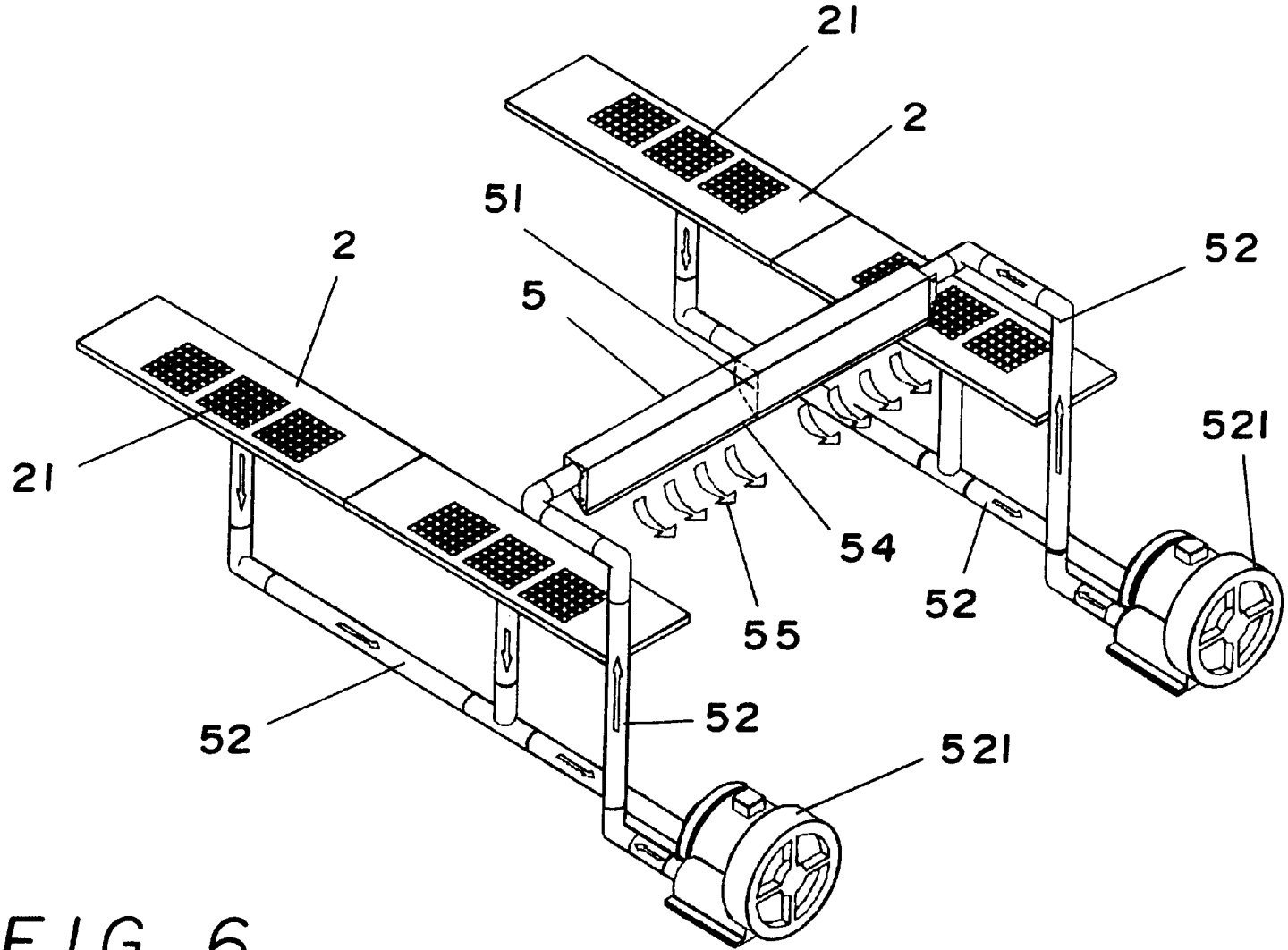
FIG. 6 is an isometric drawing of the air baffling and convergence flow distribution system at the work platform of the invention herein.
Figure 9:
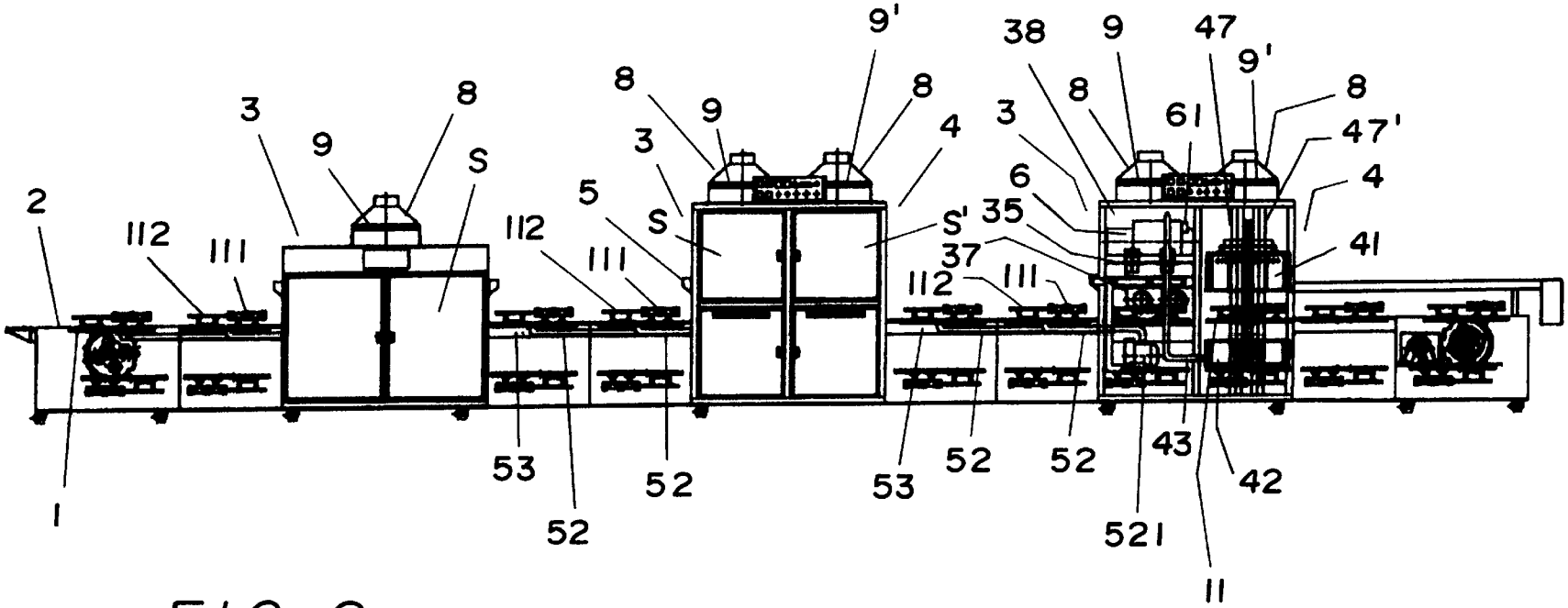
FIG. 9 is a partial cross-sectional drawing of the production line assembly of the invention herein.

Referring to FIG. 1, FIG. 6, and FIG. 9, situated in between the two sides of a work platform 2 is a conveyor belt 1 on which are disposed a number of separated conveyance frames 11, and mounted on each conveyance frame 11 are a number of footwear placement rod supports 111 and footwear placement trays 112 that form the footwear sole and upper covering conveyance units on the conveyor belt 1; the footwear placement rod supports 111 are structures that clamp the footwear upper coverings and the footwear placement trays 112 are structures on which the footwear soles are placed to facilitate the application of adhesive to the footwear sole and upper covering by the operators along the two sides of the work platform 2; the said conveyor belt 1 moves past one or more heating boxes 3 and vacuum activation boxes 4, with the conveyor belt 1 accessible between the intervals of a number of adjoined heating box 3 and vacuum activation box 4 installations, the exact number of which is determined by the type of footwear and the type of adhesive utilized to bind the footwear, thereby allowing an interchangeable assembly arrangement that accommodates different production process requirements.

Figure 2:
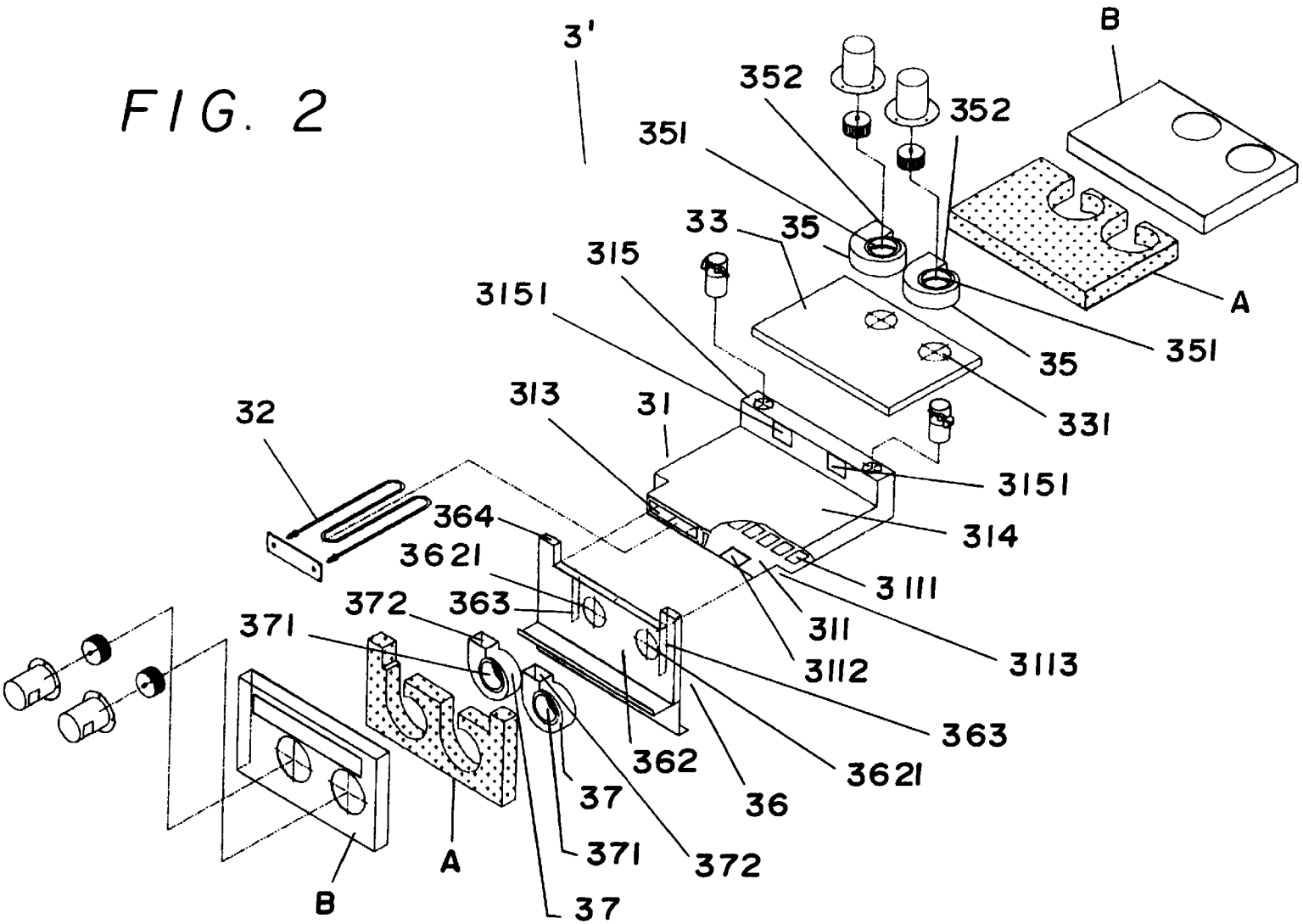
FIG. 2 is an exploded drawing of the heating box circulatory flow channel of the laterally adjoined single-sided heating box flow channel components of the invention herein.
Figure 3:
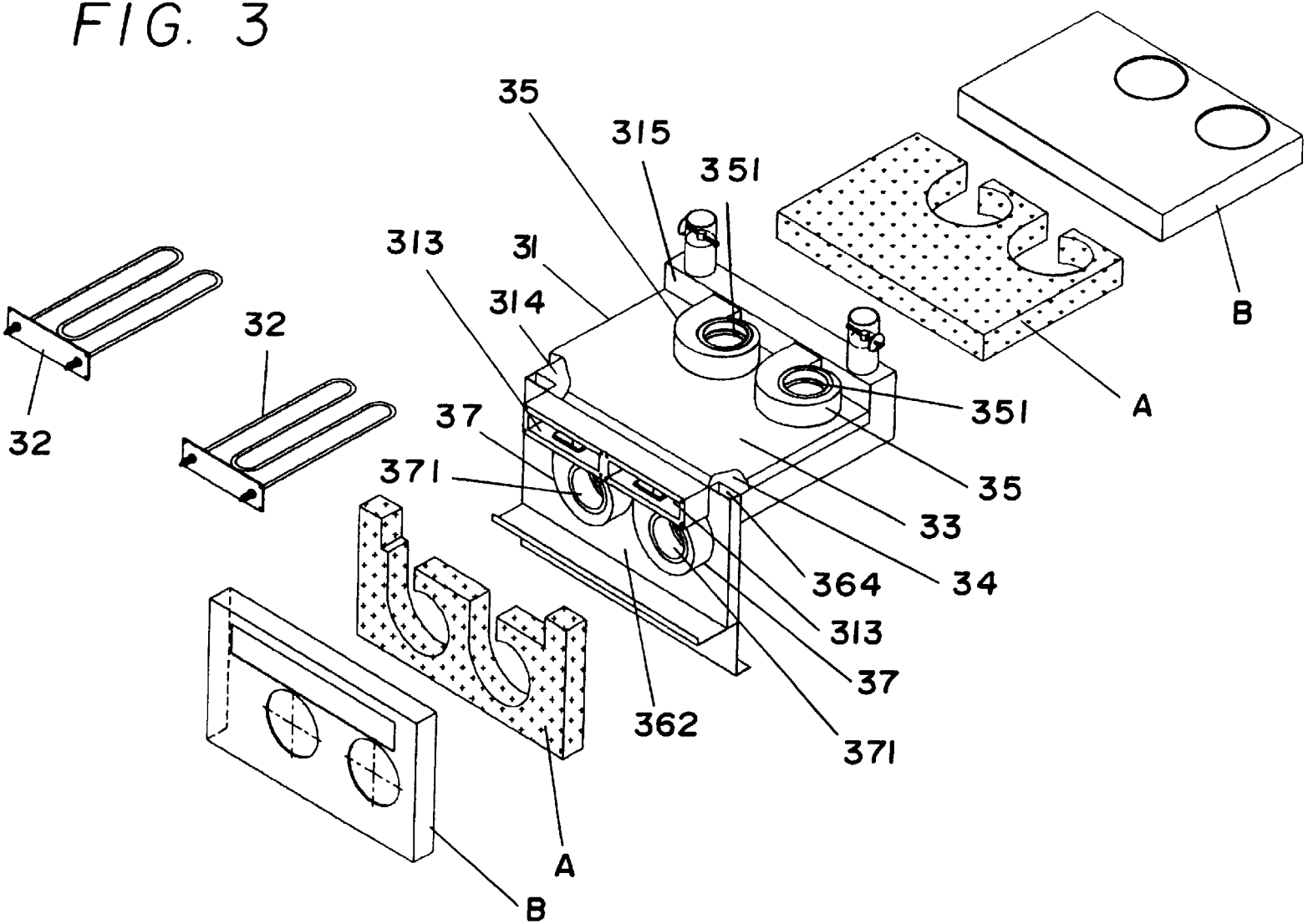
FIG. 3 is an exploded drawing of the two circulatory flow channel section of the heating box of the invention herein.
Figure 4:
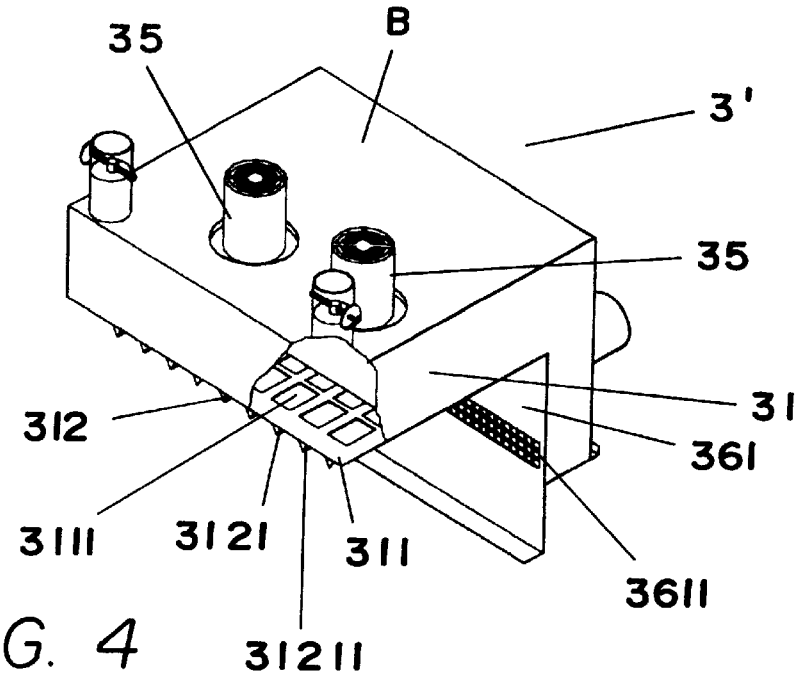
FIG. 4 is an isometric drawing of the single-sided circulatory flow channel section of the heating box of the invention herein.
Figure 4A:
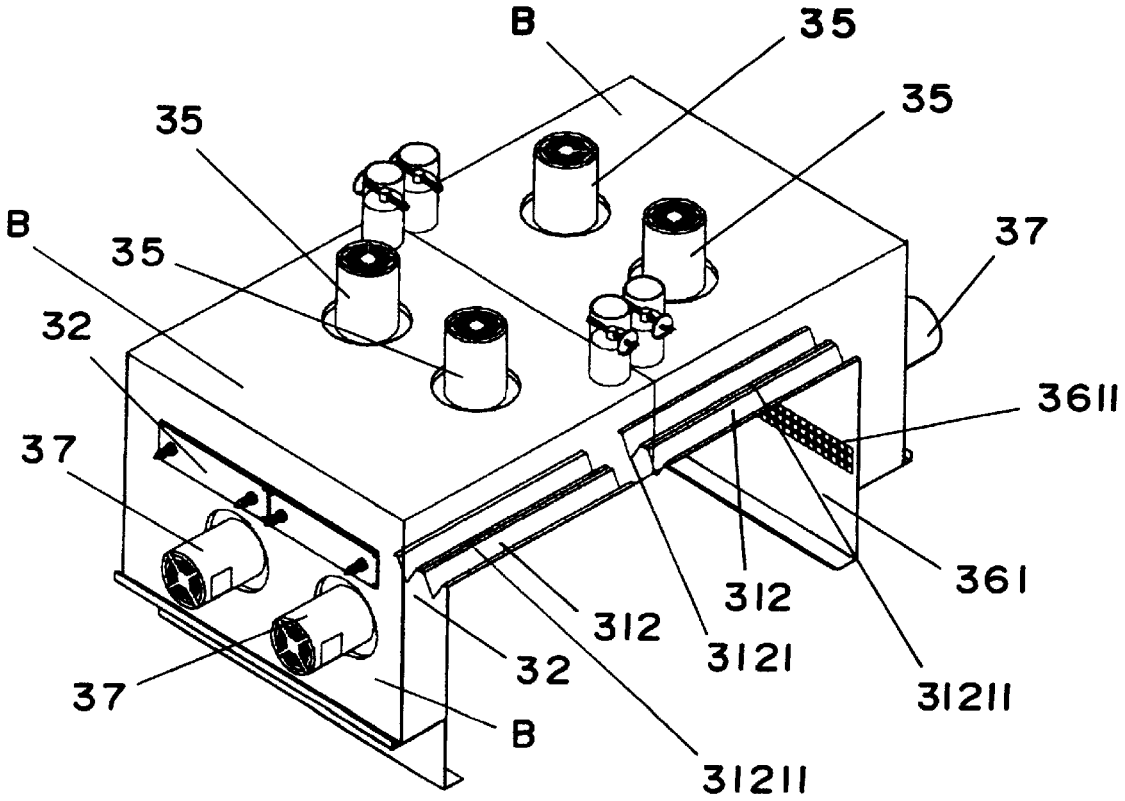
FIG. 4A is an isometric drawing of the heating box of the invention herein.
Figure 5A:
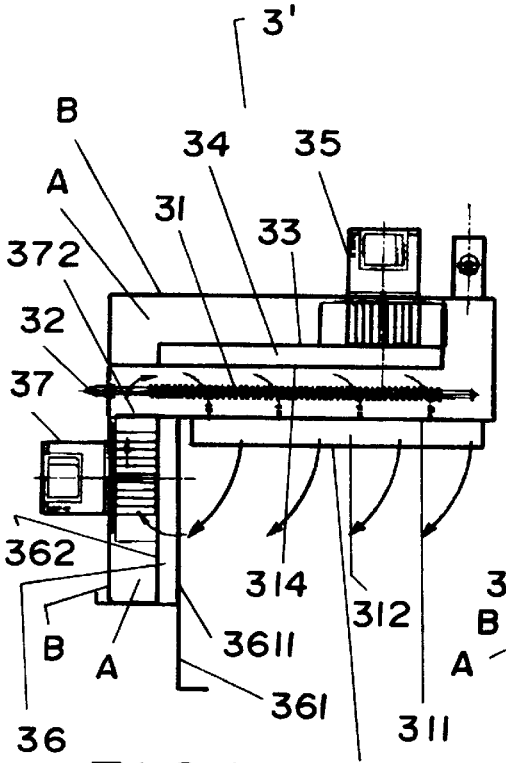
FIG. 5A is a cross-sectional drawing of the single-sided circulatory flow channel of the heating box of the invention herein.
Figure 5B:
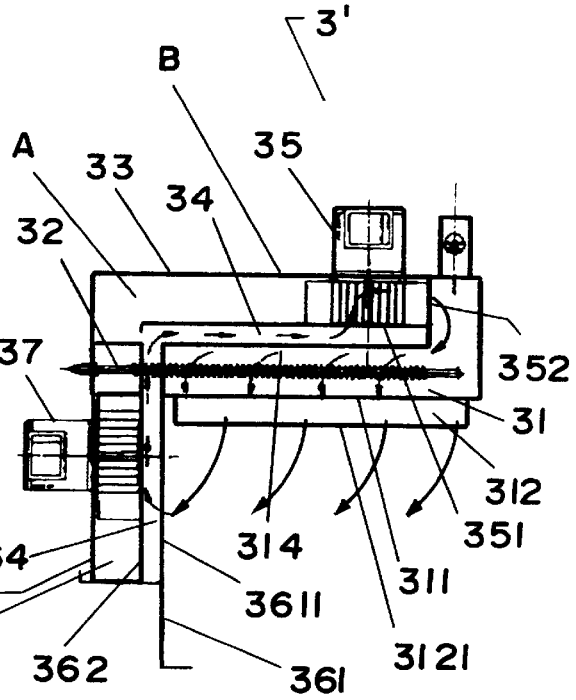
FIG. 5B is a cross-sectional drawing of the auxiliary circulatory flow channel of the heating box of the invention herein.
Figure 5C:
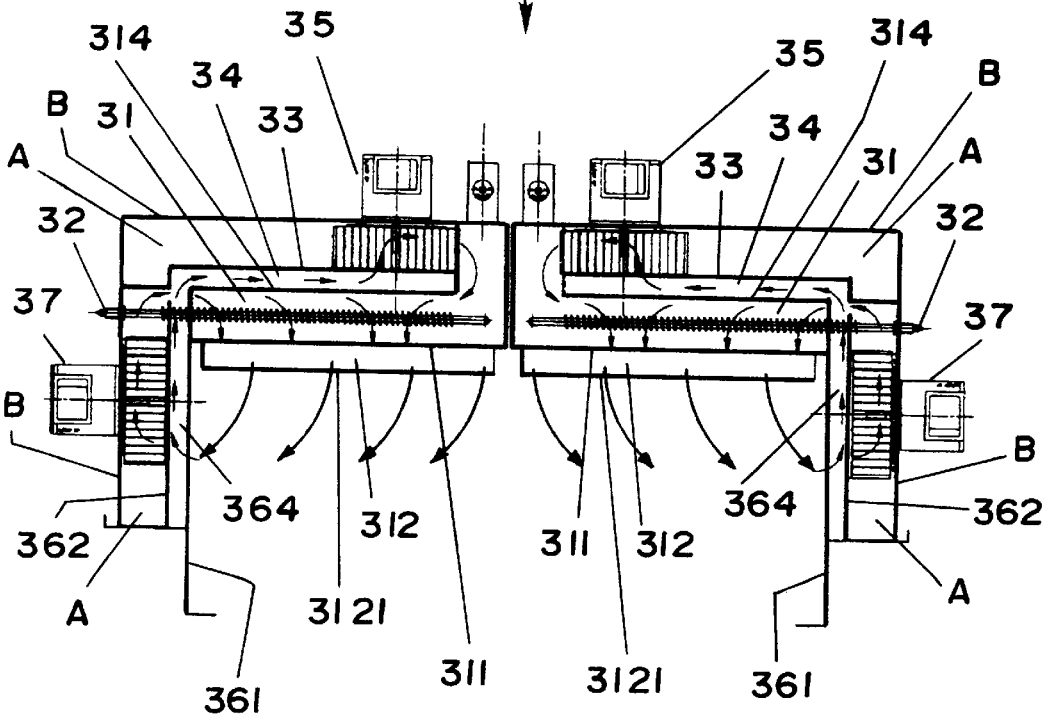
FIG. 5C is a cross-sectional drawing of the double-sided circulatory flow channels of the heating box of the invention herein.

Referring to FIG. 4 and FIG. 4A, the said heating box 3 consists of two single-sided heat circulation compartments 3' that are assembled together in an adjoined arrangement; referring to FIG. 2, FIG. 3, FIG. 4, and FIG. 4, the said single-sided circulation compartments 3' form a L-shaped air collector duct 31 having a bottom plate 311 that is arrayed with venting holes 3111 and, furthermore, there is a serrated surface 312 along the lower extent of the bottom plate 311, with rectangular holes 31211 between the serrations 3121, and there are one or more heating element 32 mounting holes 313 in the side of the L-shaped air collector duct 31, which accommodates the insertion of a heating element 32 into the L-shaped air collector duct 31 and, furthermore, the mounting of the heating element 32 onto the lower extent of the bottom plate 311, as well as a respective air guide hole 3112, and there is an opening 3113 formed at the two sides of the bottom plate 311; a planar hood 33 is situated over the upper extent of the L-shaped air collector duct 31 that enables the formation of a flow guide trap layer 34 in between the top separator plate 314 and the planar hood 33 of the L-shaped air collector duct 31 and, furthermore, there are one or more air induction ports 331 appropriately situated in the planar hood 33 that are in alignment with a number of air output ports 3151 of the adhesive fumes concentrator slot 315 on the L-shaped air collector duct 31, enabling the air intake ports 351 of a number of squirrel-cage fans 35 to coincide positionally with the air induction ports 331 of the planar hood 33, with the position of the air exhaust ports 352 of the squirrel-cage fans 35 also coincident with the air output ports 3151 of the adhesive fumes concentrator slot 315; and there is a lateral flow guide duct 36 having a side plate 361 with circulatory induction holes 3611 along the inner extent and, furthermore, an outer plate 362 with one or more air induction hole 3621 that is contiguous and appropriately situated at the inner sidelong surface, enabling the air intake ports 371 of the squirrel-cage fan 37 to be positioned on the outer plate air induction hole 3621 and the air exhaust ports 372 at the side of the squirrel-cage fans 37 to be positioned on the air guide hole 3112 in the bottom plate 311 of the L-shaped air collector duct 31; and the lateral flow guide duct 36 has a separator plate 363 that partitions the left and right ends and provides for the formation of an auxiliary flow guide channel 364; when the lateral flow guide duct 36 and the L-shaped air collector duct 31 are assembled together, the said auxiliary flow guide channel 364 is on the opening 3113 of the L-shaped air collector duct 31 and, furthermore, in continuity with the flow guide trap layer 34, with the air exhaust ports 372 at the side of the squirrel-cage fans 37 positioned on the air guide hole 3112 of the L-shaped air collector duct 31; referring to FIG. 5A, FIG. 5B, and FIG. 5C, as a result, the heated air currents inside the heating box 3 are drawn through the circulatory induction holes 3611 of the lateral flow guide duct 36 via the air intake ports 371 of the squirrel-cage fan 37, and then expelled from the air exhaust ports 372 of the squirrel-cage fans 37 and accumulated into the L-shaped air collector duct 31 (as shown in FIG. 5A); furthermore, the heated air inside the heating box 3 is drawn through the circulatory induction holes 3611 of the lateral flow guide duct 36 via the air intake ports 351 of the squirrel-cage fans 35, circulated pass the two auxiliary flow guide channels 364 into the flow guide trap layer 34, through the air exhaust ports 352 of the squirrel-cage fans 35, and then the heated air flow is accumulated into the L-shaped air collector duct 31 (as shown in FIG. 5B); as the said two heated air flows are circulated into the L-shaped air collector duct 31, the heating element 32 continues to heat them as they pass by and, furthermore, proceed to the venting holes 3111 of the bottom plate 311 and then are forcefully blown through the rectangular holes 31211 of the serrated surface 312 into the heating box 3, which enables it to remain at a constant temperature; furthermore, a heat preserving material A is situated at the upper end of the planar hood 33 and the outer side of the lateral flow guide duct 36, with two covers B place over the heat preserving material A, which maintains the temperature of the circulating heated air and thereby keeps the footwear sole and upper covering adhesive at a constant heat and, furthermore, recycles the heat energy for re-utilization and thereby lowering electric power consumption.

Referring to FIG. 6 and FIG. 9, there is an air baffling and convergence flow distribution system 5 at the conveyor belt 1 entry opening of each heating box 3 and, furthermore, there is a separator plate 51 centered in the middle section of the air baffling and convergence flow distribution system 5, with an air carrier pipe 52 extending from each of the two ends of the air baffling and convergence flow distribution system 5 that is conjoined via a squirrel-cage fan 521 to an air collector duct 53 under the work platform 2 and, furthermore, there are air intake holes 21 along the work platform 2; such that when the worker places already heated footwear soles and upper coverings on the work platform 2, the adhesive fumes are drawn via the squirrel-cage fan 521 into the air baffling and convergence flow distribution system 5 and then through the air discharge port 54 towards the inside of the high temperature heating box 3, and while the heat of the adhesive fumes are recycled in the heating box 3, air baffling is generated to disperse the adhesive fumes and minimize adhesive vapor emanations, thereby decreasing worker injuries.

Figure 7B:
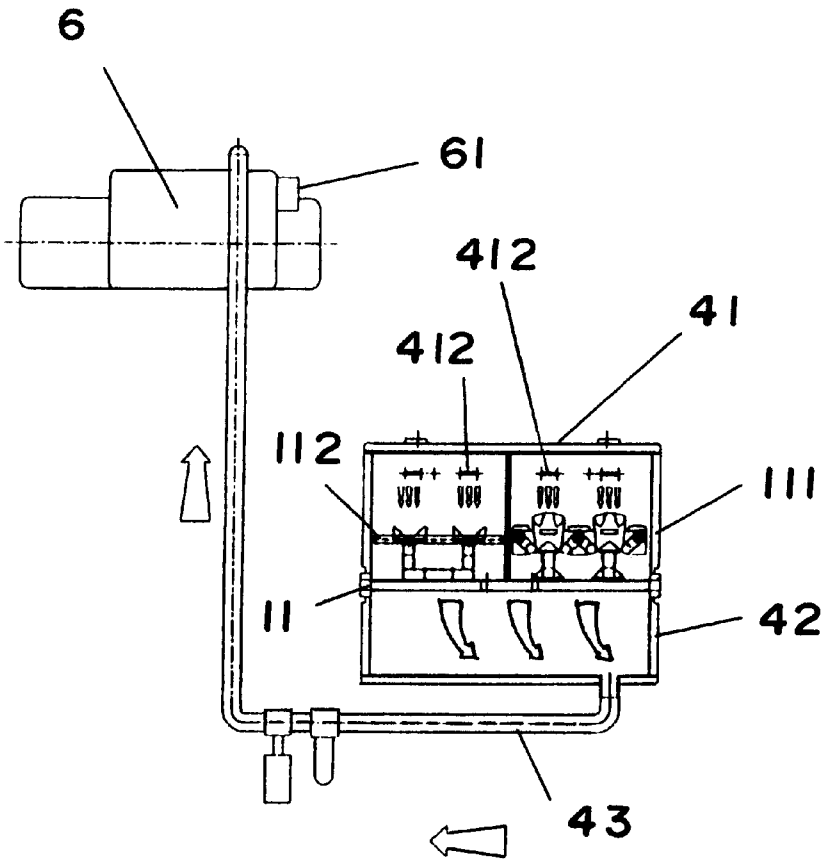
FIG. 7B is a cross-sectional drawing of the vacuum activation chamber of the invention herein that depicts its operation.
Figure 7A:
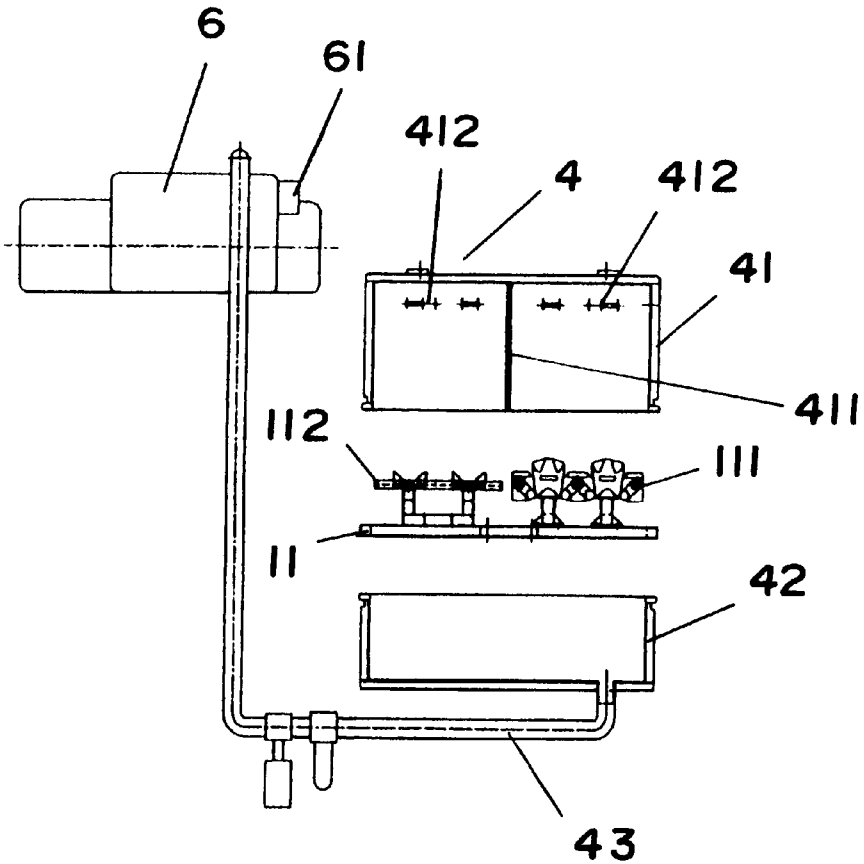
FIG. 7A is a cross-sectional drawing of the vacuum activation chamber of the invention herein.

Referring to FIG. 7A and FIG. 7B, after the adhesive applied on the footwear is dried by the heating box 3, the soles and upper covers are carried by the conveyor belt 1 into the vacuum activation box 4, of which the said vacuum activation box 4 consists of a top sealed hood 41 and a bottom sealed hood 42; a partitioning wall 411 is vertically disposed in the center of the top sealed hood 41 and there is a heater 412 mounted on the upper end of both sides of the partitioning wall 411, with each heater 412 capable of independent temperature control to the enable a different temperature setting at the soles and upper coverings on the footwear placement rod supports 111 and footwear placement trays 112; when the top and bottom sealed hoods 41 and 42 are assembled together to enclose the footwear placement rod supports 111 and footwear placement trays 112 on the conveyance frame 11, the adhesive fumes are drawn downward into the bottom sealed hood 42 through a conjoined pipe 43 and expelled through the air discharge hole 61 of a vacuum pump 6 and then dispersed outward from an exhaust box 38 at the upper end of the heating box 3 (as shown in FIG. 7B), thereby allow the setting of range of temperatures that are suitable for different material footwear soles and upper coverings with independent temperature control capability to protect the footwear, while evacuating the adhesive fumes.

Figures 8A, 8B, 8C:
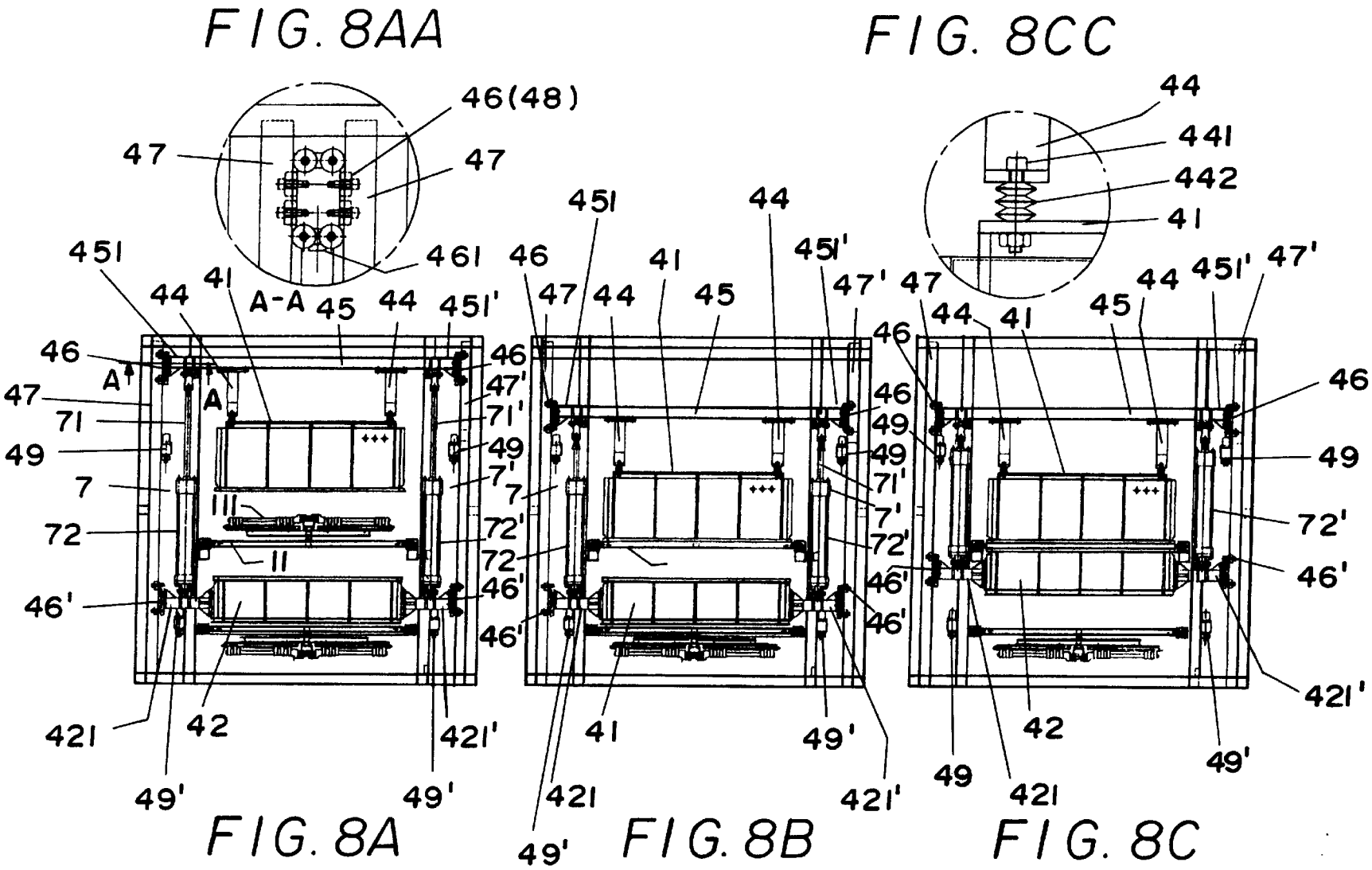
FIG. 8A is a cross-sectional drawing of the vacuum activation chamber of the invention herein in the stationery state.
FIG. 8B is a cross-sectional drawing of the vacuum activation chamber of the invention herein during one stage of operation.
FIG. 8C is a cross-sectional drawing of the vacuum activation chamber of the invention herein following a complete operating cycle.

Referring to FIG. 8A, there is a suspending rod 44 affixed at each of the four corners at the upper extent of the top sealed hood 41 of the said vacuum activation box 4, with a bolt 441 mounting the suspending rods 44 to the top sealed hood 41 (as shown in FIG. 8CC) and the bolts 441 are ensleeved in a coil spring 442 which is compressed by the suspending rod 44, and serves to keep the top sealed hood 41 properly positioned under balanced tension against conveyance frame 11 on the conveyor belt 1; the upper ends of the said four suspending rods 44 are mounted to the four corners of a suspending frame 45 having an upper left and right horizontal drive rod 451 and 451' extending from the center section of its two sides and, furthermore, mounted on the respective two ends of the upper left and right horizontal drive rods 451 and 451' are the upper left and right roller wheel assemblies 46 and 46' that are disposed against the left and right roller rails 47 and 47' (as shown in FIG. 8AA) which limits them to upward and downward movement and thereby enables the top sealed hood 41 to be moved upward and downward (as shown in FIG. 8B); extending from the two sides of the bottom sealed hood 42 are the lower left and right horizontal drive rods 421 and 421' and, furthermore, mounted on the respective two ends of the lower left and right horizontal drive rods 421 and 421' are the lower left and right roller wheel assemblies 48 and 48' that are similarly disposed against the left and right roller rails 47 and 47' which limits them to upward and downward movement and thereby enables the bottom sealed hood 42 to be moved upward and downward (as shown in FIG. 8C); the push rods 71 and 71' of the left and the right gas pressure cylinders 7 and 7', respectively, are linked to the upper left and right horizontal drive rods 451 and 451' and the bodies 72 and 72' of the left and the right gas pressure cylinders 7 and 7', respectively, are linked to the lower left and right horizontal drive rods 421 and 421'; furthermore, mounted in an appropriate area at the lower extent of the mounts 461 and 461' of the upper left and right roller wheel assemblies 46 and 46' as well as the lower extent of the lower left and right horizontal drive rods 421 and 421' are the upper and lower stop blocks 49 and 49'; referring to FIG. 8B, when the push rods 71 and 71' of the left and the right gas pressure cylinders 7 and 7' causes the downward movement of the top sealed hood 41, the mounts 461 and 461' of the upper left and right roller wheel assemblies 46 and 46' are held stationary against the upper stop block 49 and the top sealed hood 41 is enclosed over the footwear placement rod supports 111 and footwear placement trays 112 on the conveyance frame 11; referring to FIG. 8C, since the push rod 71 of the left and the right gas pressure cylinders 7 is immobilized by the upper stop block 49, the resulting upward pull of the body 72 of the left gas pressure cylinder 7 causes the bottom sealed hood 42 to be driven against the lower extent of the conveyance frame 11; conversely, when opened, then the bottom sealed hood 42 proceeds downwards and, furthermore, is halted by the lower stop block 49' and the upper sealed hood 41 is pushed upward, thereby enabling the footwear to be efficiently warmed by radiated heat and, furthermore, the vacuum extraction of water vapor and adhesive fumes from the footwear.

Figure 10A:
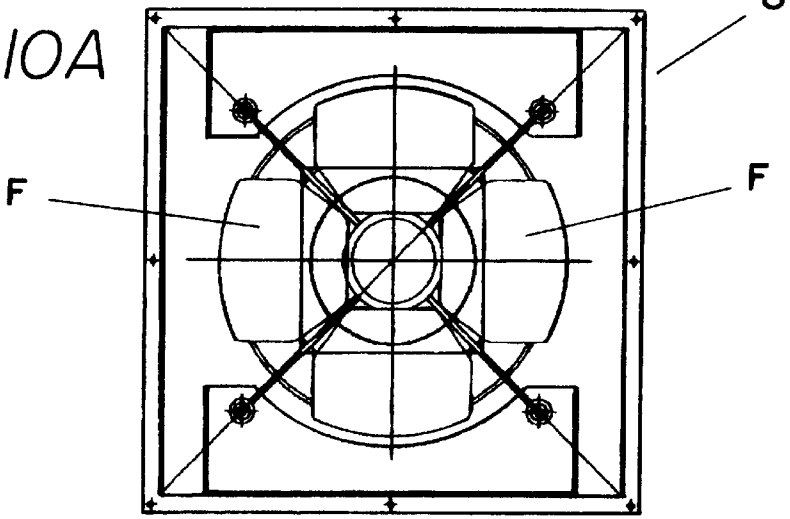
FIGS. 10A and 10B are bottom and side views; of the exhaust hood structure of the invention herein.
Figure 10B:
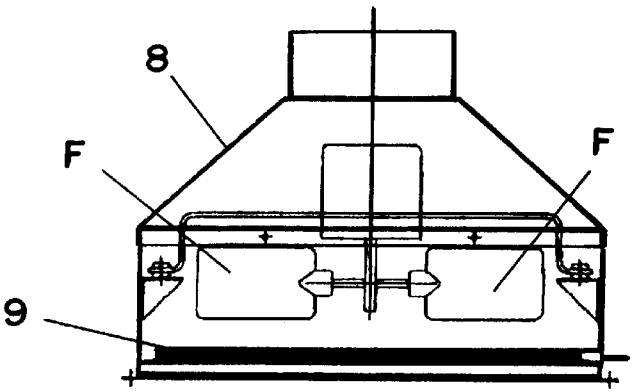
Figure 10C:
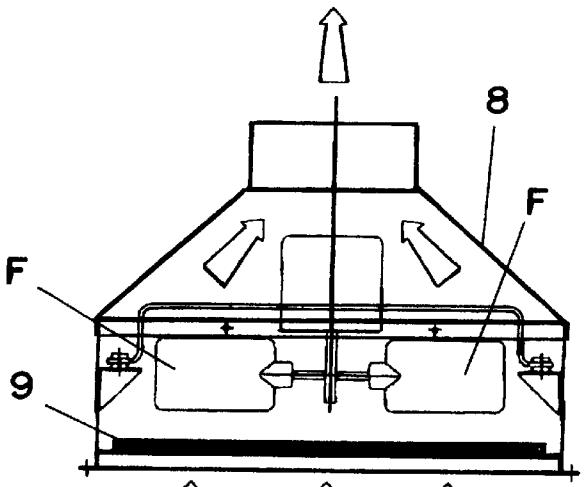
FIG. 10C is a schematic diagram showing the air flow through the exhaust hood of FIG. 10A and 10B.

Referring to FIG. 9 and FIG. 10, there is an exhaust hood 8 installed on the upper extent of the respective outer enclosures S and S' of the heating box 3 and vacuum activation box 4; an exhaust fan F is mounted in each of the said exhaust hood 8 and situated at the lower extent of the fans F are the removable-type activated carbon isolation layers 9 and 9' such that the adhesive fume ions in the heating box 3 and vacuum activation box 4 are filtered out as they pass through the activated carbon isolation layers 9 and 9' and the non-permeated air is discharged away from the production site and, furthermore, can be additionally treated to effectively achieve environmental protection objectives and provides for a convenient and practical means of industrial exhaust purification.

Figure 11A:
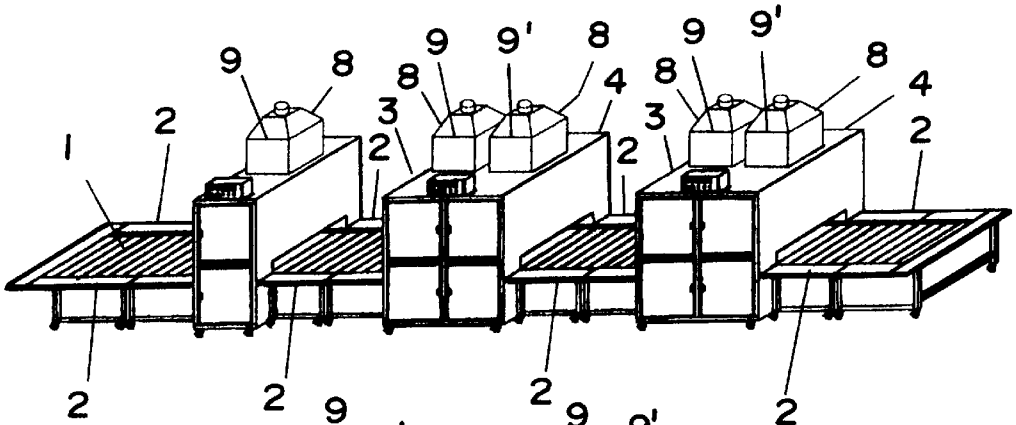
FIG. 11A is an orthographic drawing of an oil-based adhesive production line embodiment of the invention herein.
Figure 11B:
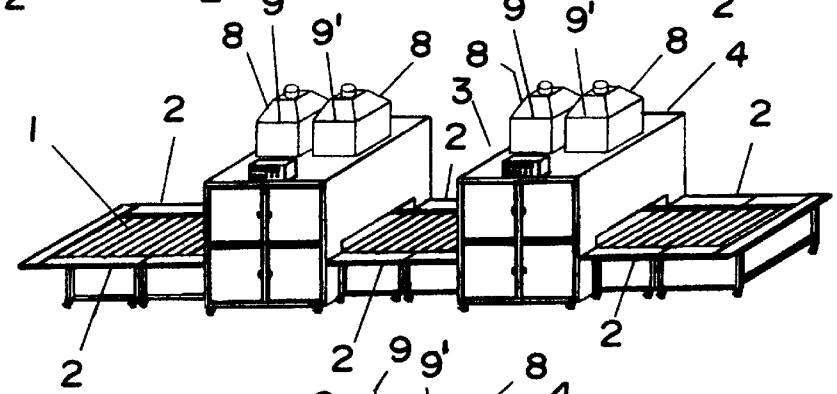
FIG. 11B is an orthographic drawing of a water-based adhesive production line embodiment of the invention herein.
Figure 11C:
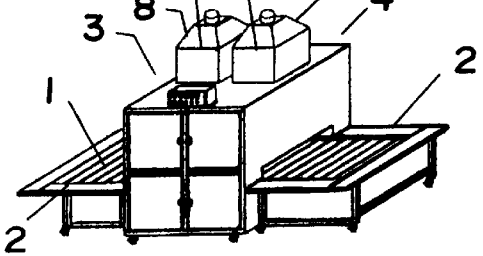
FIG. 11C is an orthographic drawing of an hot melt-based adhesive production line embodiment of the invention herein.

Referring to FIG. 11A, FIG. 11B, and FIG. 11C, the said heating box 3 and vacuum activation box 4 can be assembled according to the different types of adhesives to be utilized and individually integrated with a variable number of work platforms 2 along the conveyor belt 1; if a lower production cost oil-based adhesive is utilized and a higher adhesive application count is involved, the production line can be configured as shown in FIG. 11A; as indicated in FIG. 11B, the production line can also be set up in a shortened arrangement; in the case of higher production cost hot-melt type adhesives, the production line can be configured as shown in FIG. 11C; as such, the invention herein is capable of flexible configuration according to the dimension of the plant room, the variety of footwear, and the type of adhesive utilized, with the range of possible assembly arrangements effectively increasing the practicality of the invention herein.

What is claimed is:

1. An environmentally compliant, high productivity footwear drying and conveying apparatus comprising:

a) a conveyor having a plurality of conveyance frames, each conveyance frame having a plurality of footwear placement rod supports for supporting a plurality of footwear upper coverings thereon, and a plurality of footwear placement trays for supporting a plurality of footwear soles thereon, the conveyor passing at least one work station;

b) at least one heating box located downstream of the at least one work station and through which the conveyor passes, the at least one heating box having: an inverted U-shaped configuration with an air collector duct above the conveyor communicating with a plurality of air intake fans and having a plurality of venting holes disposed above and facing toward the conveyor, at least one heating element located in the air collector duct so as to heat air before it passes outwardly through the plurality of venting holes; a flow guide duct having an air inlet, an exhaust port and at least one flow guide duct fan to draw air in through the air inlet and out through the exhaust port whereby the air passing through the exhaust port is mixed with air in the air collector duct;

c) an air baffling and convergence flow distribution system having air intake holes at the at least one work station, at least one air discharge port oriented towards the at least one heating box, and at least one flow distribution fan connected to the air intake holes and the at least one air discharge port to draw air in through the air intake holes and exhaust air out through the at least one air discharge port; and, d) at least one vacuum activation box located downstream of and spaced from the at least one heating box, the at least one vacuum activation box having upper and lower hoods movable between open positions wherein the hoods are spaced apart above and below the conveyor, respectively, and closed positions wherein the upper and lower hoods are in sealing contact with each other and enclose at least one conveyor frame and a vacuum pump connected to one of the upper and lower hoods so as to draw a vacuum within the hoods when in the closed positions.

2. The environmentally compliant, high productivity footwear drying and conveying apparatus of claim 1 further comprising heat preserving material located in upper and lateral sides of the at least one heating box.

3. The environmentally compliant, high productivity footwear drying and conveying apparatus of claim 1 wherein the at least one vacuum activation box further comprises:

a) at least two spaced apart roller rails;

b) a suspending frame having a plurality of suspending rods connected to the upper hood, and first wheel assemblies movably engaging the at least two spaced apart roller rails such that movement of the suspending frame moves the upper hood between open and closed positions;

c) drive rods extending from the lower hood and having second wheel assemblies movably engaging the at least two spaced apart roller rails such that movement of the drive rods moves the lower hood between open and closed positions; and d) at least one actuating cylinder connected to the suspending frame and drive rods to move the upper and lower hoods between the open and closed positions.

* * * * *